US006273711B1

(12) United States Patent
Duva

(10) Patent No.: US 6,273,711 B1
(45) Date of Patent: Aug. 14, 2001

(54) LOW VELOCITY DETONATION TRAP FOR MONOPROPELLANT FUEL SYSTEMS

(75) Inventor: Anthony W. Duva, Middletown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 08/684,836

(22) Filed: Jun. 24, 1996

(51) Int. Cl.[7] ..... F23D 14/82
(52) U.S. Cl. ..... 431/346; 60/39.462
(58) Field of Search ..... 431/346; 60/39.11, 60/39.462; 220/88.2; 48/192

(56) References Cited

U.S. PATENT DOCUMENTS 802,380 * 10/1905 Emerson et al. ..... 431/346
1,407,610 * 2/1922 Westlund .
2,391,592 * 12/1945 Pierson .
2,482,457 * 9/1949 Boedecker .
2,810,631 * 10/1957 Kanenbley .

* cited by examiner

*Primary Examiner*—Carl D. Price
(74) *Attorney, Agent, or Firm*—Michael J. McGowan; Robert W. Gauthier; Prithvi C. Lall

(57) ABSTRACT

A Low Velocity Detonation (LVD) trap having acceleration, detonation and High Velocity Detonation (HVD) trap zones. The primary function is to prevent the propagation of LVD explosions in monopropellant fuel systems from propagating to the fuel storage tank. An area of decreasing diameter in the acceleration zone amplifies the pressure pulse propagation of the LVD in the fuel system to intentionally accelerate the rate of detonation such that a HVD can be precipitated in the detonation zone. The diameter of the detonation zone sufficiently violates the critical diameter for the amplified pressure pulse such that the fuel detonates as a HVD. The HVD is then trapped in the HVD trap zone which is designed in accordance with well known methods to prevent propagation of monopropellant fuel detonation from reaching the fuel storage tank. The LVD trap is particularly well suited for use in monopropellant fuel engines used to power torpedoes and in facilities associated with torpedo testing.

2 Claims, 1 Drawing Sheet

LOW VELOCITY DETONATION TRAP FOR MONOPROPELLANT FUEL SYSTEMS

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

This invention relates generally to monopropellant fuel systems and to torpedo engines and pumping facilities using a monopropellant fuel. More particularly, the present invention relates to detonation traps and the use of detonation traps to prevent the combustion of the monopropellant fuel outside of the prescribed combustion chamber.

(2) Description of the Prior Art

It is known to propel a torpedo with a propulsion system which uses an external combustion expander-type engine in conjunction with a monopropellant fuel. In this type of system, a solid initiator monopropellant fuel is combusted in the combustion chamber, producing a hot, energized gas which commences drive action of the torpedo and initiates the entry of a liquid, pressure-sensitive, sustainer monopropellant fuel into the combustion chamber through a poppet valve. Assuming that the pressure in the combustion chamber is sufficiently high, heat generated in the combustion of the initiator propellant effects combustion of the initial quantity of sustainer propellant which is admitted to the combustion chamber. Subsequently, combustion of the sustainer fuel continues in a self-sustaining manner due to the high temperature and pressure in the chamber, i.e., part of the energy generated in the combustion of the sustainer monopropellant is used to combust additional sustainer monopropellant.

By the nature of their formulation, monopropellants are inherently unstable in so much as they do not require an external oxygen source to burn. The sensitivity of the monopropellant fuel increases with increasing pressure and becomes susceptible to spontaneous combustion. Extreme precautions are taken to prevent the combustion of the fuel outside of the prescribed combustion chamber. It has been observed and is well known in the art that, for a given monopropellant fuel at a given pressure, there exists a critical diameter beyond which combustion does not occur. The critical diameter decreases as the pressure increases. This data is used in developing the piping for the fuel systems used in engines utilizing monopropellant fuels. There exists the possibility that an explosion of the monopropellant fuel in the vicinity of the fuel pump may propagate back to the fuel storage tank. Periodic occurrences of fuel pump detonation have caused significant damage to pumping systems and associated engine components through such explosions. The critical diameter is used in designing detonation traps to prevent this propagation. By containing the explosion in the vicinity of the fuel pump, the detonation trap minimizes the available volume of monopropellant fuel which can participate in the explosion. Current detonation traps are designed using a series of parallel flow paths much smaller than the critical diameter determined for the specific monopropellant fuel being used.

There exists a major flaw in the design of current detonation traps in that monopropellant combustion occurs in two forms, high velocity detonation (HVD) and low velocity detonation (LVD). In the case of HVD, the present design combustion traps adequately reflect the pressure wave of the explosion and prevent the fuel tank monopropellant from entering the explosion reaction. In the case of LVD, the low propagation rate results in a pressure wave significantly less than the HVD pressure wave such that the critical diameter for a HVD does not apply. The LVD propagates through the HVD trap and detonates the monopropellant in the fuel tank. On one occasion, a LVD was determined to be the cause for the detonation of the associated fuel storage tank. When the storage fuel tank detonated, as can be expected, significant facility damage occurred. The standard HVD detonation trap failed to provide the pressure wave reflection required to isolate the fuel storage system from the LVD shock. The LVD proceeded through the HVD trap and precipitated initiation of the monopropellant in the fuel storage tank.

SUMMARY OF THE INVENTION

Accordingly, it is an object of the invention to provide additional safety features to a monopropellant fuel system.

It is another object of the invention to provide a positive means to prevent low velocity detonations in high pressure monopropellant pumping systems from propagating to the monopropellant fuel storage system in torpedoes.

These and other objects of the invention are realized by providing a monopropellant fuel system with a detonation trap which will prevent both HVD and LVD from propagating to the fuel storage tank. The detonation trap consists of a primary chamber which amplifies a LVD, a secondary chamber where the amplified LVD is detonated and a conventional HVD detonation trap. As the LVD begins propagating through the primary chamber, the pressure wave is amplified sufficiently for the LVD to fall within the pressure envelope where a critical diameter would apply. The amplified pressure wave then enters the secondary chamber which has a diameter which intentionally violates the critical diameter for the amplified pressure wave. The fuel detonates within the secondary chamber creating a HVD. The newly formed HVD encounters the conventional HVD detonation trap and is prevented from propagating to the fuel storage tank.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
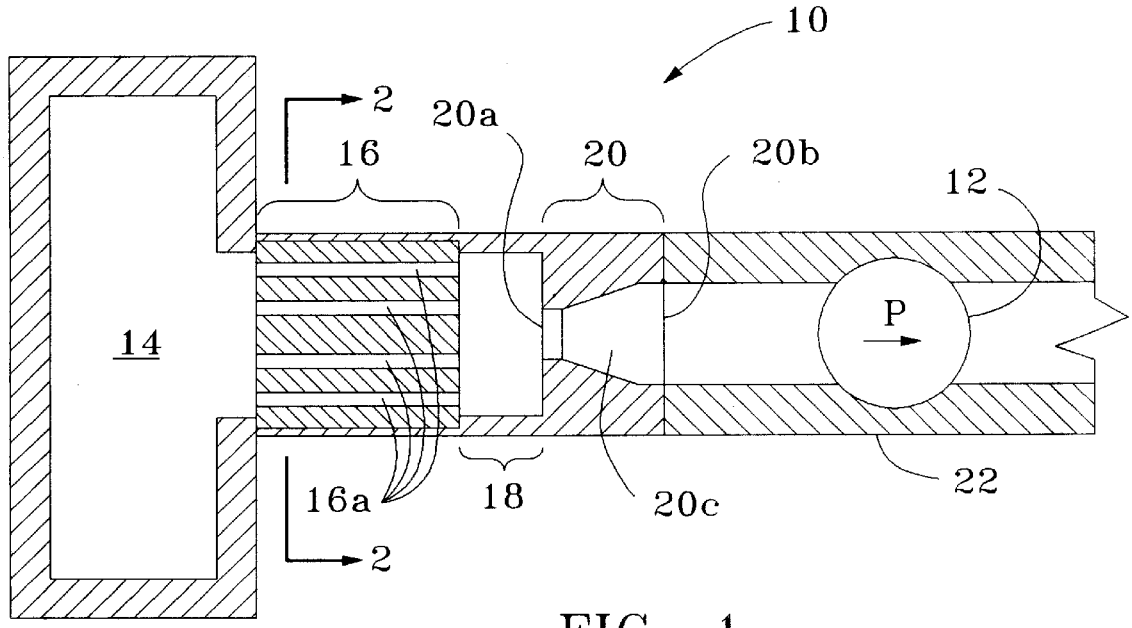
FIG. 1 is a schematic sectional view of the LVD trap device in accordance with the present invention.
Figure 2:
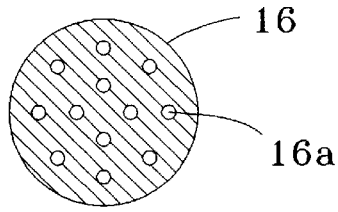
FIG. 2 is a sectional view taken at line 2—2 of FIG. 1 which defines the HVD combustion trap portion of the invention.

Referring now to FIG. 1, there is shown a schematic sectional view of a detonation trap 10 according to the present invention. Trap 10 is located within a fuel distribution system of a monopropellant engine (not shown). Detonation trap 10 is Trap 10 is essentially a housing having three sections for passage of fuel from tank 14 to pump 12. placed between fuel transfer pump 12 and fuel storage tank 14. Trap 10 consists of a conventional HVD trap section 16 a detonation zone 18, and an accelerator section 20. Referring additionally to FIG. 2, there is shown a cross section of HVD trap section 16 taken at line 2—2 of FIG. 1. HVD trap section 16 is formed of a perforated plate having multiple passages 16*a*, one of which is indicated on the drawing. The diameter of each passage is smaller than the critical diameter for the monopropellant being used. The small diameters of passages 16*a* prevent a HVD originating at pump 12 from propagating through HVD trap section 16 to fuel storage tank 14. It is to be appreciated that, with the exception of certain improvements to the detonation trap, to be described herein, the operation and construction of a HVD trap is conventional and known.

Detonation zone 18 has a diameter larger than the critical diameter for the monopropellant fuel being used in the system. The diameter of accelerator section 20 at detonation zone side 20*a* is smaller than the diameter of detonation zone 18 and also smaller than the diameter of fuel line 22. The diameter of accelerator section 20 increases until the diameter at pump side 20*a* generally matches the diameter of fuel line 22. Again, the diameter of fuel line 22 is larger than the critical diameter.

When an explosion initiates at pump 12, the HVD propagates through fuel line 22, through accelerator section 20 and detonation zone 18 and into trap section 16. Because the diameter of passages 16*a* are designed to be smaller than the critical diameter, the HVD is prevented from propagating to fuel storage tank 14 as in a conventional HVD trap. When a LVD is initiated at pump 12, the pressure wave is amplified as it passes through constricted passageway 20*c* of accelerator section 20 and is allowed to expand into detonation zone 18. The amount of amplification is sufficient to bring the pressure wave within the range where critical diameters apply. The diameter of detonation zone 18 is such that it violates the critical diameter for the amplified pressure wave sufficiently to cause the fuel to detonate, creating a HVD. The resulting HVD is prevented from propagating through trap section 16 in the conventional manner.

What has thus been described is a device for preventing both high velocity and low velocity detonations from propagating through a fuel distribution system of a monopropellant engine to the fuel storage tank of the engine. The device is mounted between the fuel storage tank and the fuel pump of the fuel distribution system. The device consists of a conventional HVD trap to which are added a detonation zone and an accelerator section. The pressure wave of a low velocity detonation initiated at the fuel pump enters the accelerator section of the device and is amplified as the diameter of the passageway within the accelerator section decreases. The pressure wave is then allowed to expand into the detonation zone. The diameter of the detonation zone is sufficiently larger than the critical diameter for the amplified pressure wave such that the fuel detonates as a HVD. The HVD is then trapped by the conventional HVD trap portion of the device.

obviously, many modifications and variations of the present invention may become apparent in light of the above teachings. For example, as an alternative to the above described approach of achieving HVD in the detonation zone, passageway 20*c* can be a plurality of passageways, each having decreasing diameters in the direction from the pump to the storage tank. Furthermore, there exist multiple methods and configurations to achieve a HVD combustion trap using a perforated plate with conduits of diameters less than the critical diameter for combustion associated with the specific monopropellant. Such plates are conventional and known in the art, and available in a variety of physical dimensions and configurations.

It is therefore to be understood that within the scope of the appended claims, the invention may be practiced otherwise than as specifically described.

What is claimed is:

1. A low velocity detonation trap for preventing propagation of a low velocity detonation of monopropellant fuel within a fuel system, the detonation trap comprising:

a housing having a fuel flow passage therein extending between and in fluid communication with a fuel inlet at a first end of the housing and a fuel outlet at a second end of the housing, the fuel inlet connected to and in fluid communication with an upstream portion of the fuel system and the fuel outlet connected to and in fluid communication with a downstream portion of the fuel system;

an acceleration zone portion of the fuel flow passage adjacent the fuel outlet, the acceleration zone converging from a first diameter at the fuel outlet to a smaller diameter in a direction away from the fuel outlet, the acceleration zone receiving the low velocity detonation propagating within the downstream portion and amplifying a pressure wave associated with the low velocity detonation to an energized state capable of high velocity detonation;

an expansion area portion of the fuel flow passage in fluid communication with the acceleration zone, the expansion area adjacent to and upstream from the acceleration zone and receiving the amplified pressure wave from the acceleration zone, the expansion area having an expansion diameter larger than a critical diameter of the monopropellant fuel to ensure detonation of the fuel as a high velocity detonation; and a high velocity detonation trap portion of the fuel flow passage adjacent the fuel inlet, the high velocity detonation trap in fluid communication with the expansion area and having a plurality of trap passages, the trap passages each having a trap diameter smaller that the critical diameter, the high velocity detonation trap receiving the high velocity detonation and preventing further propagation of the high velocity detonation within the upstream portion of fuel system.

2. A low velocity detonation trap for preventing propagation of a low velocity detonation of monopropellant fuel within a monopropellant fuel system, the detonation trap comprising:

a housing having a fuel flow passage therein extending between and in fluid communication with a fuel pump of the fuel system at a first end of the housing and a fuel storage tank of the monopropellant fuel system at a second end of the housing;

an acceleration zone portion of the fuel flow passageway adjacent the fuel pump, the acceleration zone converging from a first diameter at the fuel pump to a smaller diameter in a direction away from the fuel pump, the acceleration zone receiving the low velocity detonation propagating through and from the fuel pump and amplifying a pressure wave associated with the low velocity detonation to an energized state capable of high velocity detonation;

an expansion area portion of the fuel flow passage in fluid communication with the acceleration zone, the expansion area adjacent to and upstream from the acceleration zone and receiving the amplified pressure wave from the acceleration zone, the expansion area having an expansion diameter larger than a critical diameter of the monopropellant fuel to ensure detonation of the fuel as a high velocity detonation; and a high velocity detonation trap portion of the fuel flow passageway adjacent to the fuel storage tank, the high velocity detonation trap in fluid communication with the expansion area and receiving the high velocity detonation to prevent further propagation of the high velocity detonation within the fuel storage tank.

* * * * *